US006008576A

United States Patent [19]

Nakatani et al.

[11] Patent Number: 6,008,576

[45] Date of Patent: Dec. 28, 1999

[54] FLAT DISPLAY AND PROCESS FOR PRODUCING CATHODE PLATE FOR USE IN FLAT DISPLAY

[75] Inventors: Tadashi Nakatani; Keiichi Betsui, both of Kawasaki, Japan

[73] Assignee: Fujitsu Limited, Kanagawa, Japan

[21] Appl. No.: 08/879,133

[22] Filed: Jun. 19, 1997

[30] Foreign Application Priority Data

Jun. 20, 1996 [JP] Japan ..... 8-160151

[51] Int. Cl.[6] ..... H01J 31/12

[52] U.S. Cl. ..... 313/495; 313/497; 313/553; 313/308; 313/309; 313/336; 313/351

[58] Field of Search ..... 313/495, 496, 313/497, 553, 306, 308, 309, 336, 351

[56] References Cited

U.S. PATENT DOCUMENTS

| | | | |
|---|---|---|---|
| 4,857,799 | 8/1989 | Spindt et al. | 313/309 X |
| 5,015,912 | 5/1991 | Spindt et al. | 313/495 |
| 5,216,324 | 6/1993 | Curtin | 313/495 |
| 5,223,766 | 6/1993 | Nakayama et al. . | |
| 5,408,161 | 4/1995 | Kishino et al. | 313/495 |

FOREIGN PATENT DOCUMENTS

| | | |
|---|---|---|
| 5-94787 | 4/1993 | Japan . |

*Primary Examiner*—Ashok Patel
*Attorney, Agent, or Firm*—Nikaido Marmelstein Murray & Oram LLP

[57] ABSTRACT

A flat display is provided, which includes: a cathode plate including emitter electrode lines each having emitter tips provided in pixel areas, and gate electrode lines crossing the emitter electrode lines at the pixel areas; and an anode plate spaced a predetermined distance from the cathode plate in an opposed relation and having an anode conductive layer and fluorescent layers formed on the anode conductive layer in the respective pixel areas; the emitter electrode lines and the gate electrode lines each having transparent portions formed of a transparent conductive film at least in the pixel areas so that light emission from the fluorescent layers can be viewed through the transparent portions.

21 Claims, 16 Drawing Sheets

FLAT DISPLAY AND PROCESS FOR PRODUCING CATHODE PLATE FOR USE IN FLAT DISPLAY

BACKGROUND OF THE INVENTION

1. Field of the Invention

The present invention relates to a flat display and a process for producing a cathode plate for use in the flat display. The cathode plate according to the present invention comprises minute field emission cathodes and can ensure a higher electron emission efficiency and a higher luminosity than a conventional thermionic cathode, and is a promising electron source for a flat display, an image pickup tube and the like. Particularly, a display device employing such minute field emission cathodes is of a self-luminous type, and can exhibit a higher luminance and a higher resolution. Further, the display device has excellent characteristics (e.g., wide view angle, quick response and low power consumption).

2. Description of Related Art

FIG. 14 shows one exemplary construction of a display device employing a conventionally known minute field emission cathode.

The minute field emission cathode includes conical emitter tips 101 each having a sharp tip, gate electrode lines (gate power supply lines) 103 for extracting electrons, emitter electrode lines (emitter power supply lines) 102 for applying a negative voltage to the emitter tips, and an insulation layer 104 for isolating the gate electrode lines from the emitter electrode lines. The minute field emission cathode is disposed on a glass substrate 105 as shown in FIG. 14. The entire cathode structure including the glass substrate is herein called a cathode plate 109. Several hundred to several thousand emitter tips are formed on the emitter electrode lines 102 within each of intersection areas where the emitter electrode lines 102 intersect the gate electrode lines 103.

One display element (e.g., pixel) 106 comprises these several hundred emitter tips.

A voltage is applied between the emitter tips 101 and the gate electrode lines 103, and electrons are extracted from the emitter tips 101 into a vacuum space by field emission. The emitter tips 101 each having a micron size are formed at a high integration density by utilizing semiconductor microprocessing techniques.

The field emission characteristic is non-linear, so that the emitter electrode lines and the gate electrode lines can be driven by simple matrix addressing. Electrons extracted from emitter tips in a selected pixel impinge on a transparent anode plate 107 which is spaced several hundred micrometers from the minute field emission cathode in an opposed relation.

The anode plate 107 includes fluorescent layers 108 formed in a stripe pattern on its surface. The fluorescent layers 108 are excited to emit light when electrons impinge on the fluorescent layers 108. The light emission is observed through the anode plate 107 from the top of FIG. 14 by a user.

FIGS. 15(*a*) to 15(*h*) show a process for producing matrix elements of the minute field emission cathode by a conventionally employed vacuum deposition.

An emitter power supply film 117 is formed on an insulative substrate 116 such as of a glass as shown in FIG. 15(*a*), and patterned into emitter electrode lines 102 as shown in FIG. 15(*b*).

Subsequently, an insulating film 118 and a gate power supply film 119 are formed in this order over the resulting substrate as shown in FIG. 15(*c*).

As shown in FIG. 15(*d*), the gate power supply film 119 and the insulating film 118 are respectively etched with the use of a resist pattern having circular openings for formation of cylindrical gate openings 120.

As shown in FIG. 15(*e*), a sacrificial film material such as aluminum is deposited on the resulting substrate obliquely with respect to the insulative substrate 116 for formation of a sacrificial film 121 in such a manner that the material is not deposited on portions of the emitter power supply film 117 exposed within the gate openings 120.

As shown in FIG. 15(*f*), an emitter tip material 122 such as molybdenum is deposited on the resulting substrate vertically with respect to the insulative substrate 116. As the emitter tip material is deposited with time, the gate openings 120 are gradually covered with the emitter tip material. When the gate openings 120 are completely covered, conical emitter tips 101 are formed within the respective gate openings 120 as shown in FIG. 15(*f*).

In turn, portions of the emitter tip material 122 except the emitter tips 101 are removed by selectively etching the sacrificial film 121 with an aqueous solution of phosphoric acid as shown in FIG. 15(*g*).

Finally, the gate power supply film 119 is patterned into a desired configuration as shown in FIG. 14 for formation of gate electrode lines 103. Thus, the minute field emission cathode is completed as shown in FIG. 15(*h*).

The display device shown in FIG. 14 is constructed such that the cathode plate 109 including the minute field emission cathode formed on the glass substrate 105 is bonded to the anode plate in an opposed relation with spacers (not shown) interposed therebetween for keeping a spacing of several hundred micrometers therebetween. The light emission from the fluorescent layers is viewed through the anode plate 107 from the top of FIG. 14.

Although the minute field emission cathode itself is capable of emitting electrons at a high current density in a very high vacuum, the conventional display device fails to ensure a high luminosity because of a low luminous efficiency of the fluorescent layers.

Further, an acceleration voltage to be applied to the anode 107 is limited to several hundred volts at the maximum because of the small spacing between the cathode plate 109 and the anode plate 107. Fluorescent materials which can be excited for light emission by electron beams accelerated at a voltage of several hundred volts have been put in practical use for fluorescent display tubes, but only green fluorescent materials have sufficiently high luminous efficiencies.

Since a low speed electron beam can penetrate through only a several-atom surface layer of a fluorescent layer, only the surface layer emits light. In the case of the display device having the conventional construction shown in FIG. 14, the light emission from the surface layer of the fluorescent layer is observed through the anode plate 107 (including the fluorescentlayers 108 and the glass substrate) from the rear side thereof. Since the light is scattered toward the side of the cathode plate 109 by the fluorescent layers 108, a luminosity observed from the rear side of the anode plate is lower than that observed from the side of the cathode plate.

FIG. 16(*a*) is a schematic view illustrating one exemplary construction of the conventional anode plate 107. As shown, a user views light emission through a fluorescent layer 108 and the glass substrate from a position FLVFD and, therefore, the luminosity is lower than when the scatter light is directly viewed from a position VFD.

As shown in FIG. 16(*b*), where the fluorescent layer is formed of ZnO:Zn and has a thickness of about 10 $\mu$m (i.e., a thickness equivalent to the thickness of a one- or two-particle layer of a fluorescent substance), the luminosity observed from the position FLVFD is the maximum but only about 60% of that observed from the side of the light emission face (from the position VFD). Further, the formation of such a thin fluorescent layer requires a highly advanced technique.

On the other hand, the luminance of the fluorescent layer can be increased by increasing the density of current to be applied thereto, because the luminance is directly proportional to the product of the luminous efficiency of the fluorescent layer and an electric power (the product of a current density and an acceleration voltage) applied to the fluorescent layer. However, the luminous efficiency levels off even if the current density is increased. In addition, the excitation of the fluorescent layers at a high current density shortens the lifetime of the fluorescent layers.

If the acceleration voltage to be applied to the anode plate is increased to the order of several kilovolts, the required current density can be reduced so that a fluorescent material adapted for high speed electron beam excitation for used in CRTs can be employed. The application of a higher acceleration voltage requires a higher insulation withstand voltage which is attained by increasing the gap (spacing) between the cathode plate and the anode plate. However, spacers having a high aspect ratio are required for increasing the gap without increasing a pixel pitch, and the formation of such spacers is not easy. Further, the increase in the gap between the cathode plate and the anode plate results in image blurring and color diffusion, because electron beams from the cathode diffuse to adjacent pixels. Therefore, an additional electrode for converging electron beams is required.

In the conventional display device shown in FIG. 14, a getter for adsorbing gas particles emanating from the fluorescent layers 108 and the like is required, from a structural viewpoint, to be provided in an area separate from a display area where the pixels are provided. More specifically, the getter accommodating area is located in a position remote from the display area. Therefore, a greater amount of the getter and a larger getter accommodating area are required as the display area is increased.

Unlike the CRTs and fluorescent display tubes, the display device employing the minute field emission cathode has a very small ventilation conductance and, therefore, it requires much time for the getter to adsorb a gas emanating from the fluorescent layers due to electron bombardment and a gas emanating from the cathode plate and the spacers due to ion bombardment. The vacuum level around the emitter tips is locally reduced with time due to the gas emanating from the fluorescent layers. The reduction in the vacuum level causes arc discharge, resulting in destruction of the emitter tips.

The reduction in the vacuum level, though not causing arc discharge, reduces the electron emission from the emitter tips. In general, the value of the emission current from the emitter largely depends on the vacuum level around the emitter. This is because oxygen molecules and water molecules in a residual gas are adsorbed on the surface of the emitter to increase a work function on the emitter surface. That is, a display device constructed such that getters are provided along edges of the display panel has a problem associated with the lifetime thereof. The distances between the getters and emitter tips located in a central portion of the display area are increased as the display area is increased. This aggravates the lifetime problem.

Japanese Laid-Open Patent No. Hei 5(1993)-94787 has disclosed a fluorescent display apparatus which has an electric field emission element (FEC), and a light transmissive part is formed between FECs. U.S. Pat. No. 5,223,766 has disclosed a image display device with cathode panel and gas absorbing getters.

SUMMARY OF THE INVENTION

In accordance with the present invention, there is provided a flat display comprising: a cathode plate including emitter electrode lines each having emitter tips provided in pixel areas, and gate electrode lines crossing aft the emitter electrode lines at the pixel areas; and an anode plate spaced a predetermined distance from the cathode plate in an opposed relation and having an anode conductive layer and fluorescent layers formed on the anode conductive layer in the respective pixel areas; the emitter electrode lines and the gate electrode lines each having transparent portions formed of a transparent conductive film at least in the pixel areas so that light emission from the fluorescent layers can be viewed through the transparent portions.

The flat display of the present invention can exhibit a high luminance, because light emission from the fluorescent layers is viewed through the cathode plate.

BRIEF DESCRIPTION OF THE DRAWINGS

FIG. 16(*b*) is a graphical representation illustrating the luminous intensity of the conventional anode plate.

DESCRIPTION OF THE PREFERRED EMBODIMENTS

Figure 1:
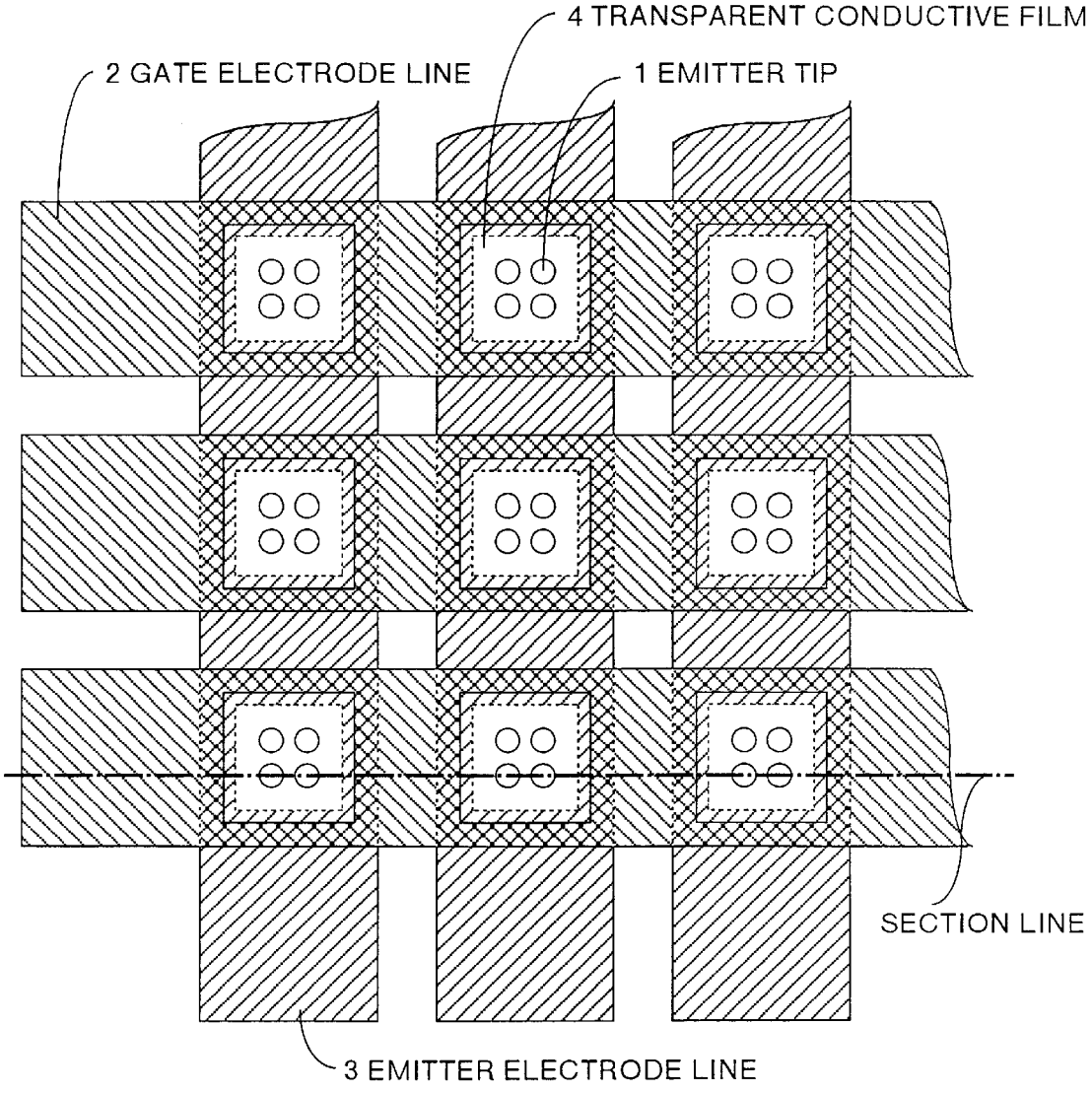
FIG. 1 is a diagram illustrating the construction of a cathode plate according to a first embodiment of the present invention.

The flat display of the present invention comprises: a cathode plate including emitter electrode lines each having emitter tips provided in pixel areas, and gate electrode lines crossing the emitter electrode lines at the pixel areas; an anode plate spaced a predetermined distance in an opposed relation and having an anode conductive layer and fluorescent layers formed on the anode conductive layer in the respective pixel areas; the emitter electrode lines and the gate electrode lines each having transparent portions formed of a transparent conductive film at least in the pixel areas so that light emission from the fluorescent layers can be viewed through the transparent portions.

The flat display may further include a floating gate electrode portion provided in an area embracing a group of emitter tips within each of the pixels and isolated from a gate electrode line. The floating gate electrode portion is formed of a transparent conductive film, and connected to the gate electrode line via a narrow metal film bridge.

The flat display further includes a rear plate disposed on a side of the anode plate opposite to the cathode plate and a getter provided in a ventilation space defined between the anode plate and the rear plate, and the anode plate has a plurality of ventholes formed therein.

The ventholes may be provided adjacent to the fluorescent layers on the anode plate. The getter may include a plurality of getter plates which are supported on the rear plate to face opposite to the respective ventholes.

The cathode plate is preferably formed on a transparent substrate to increase the luminance of the flat display.

In accordance with another aspect of the present invention, there is provided a process for producing a cathode plate for use in a flat display, which comprises the steps: forming emitter electrode lines each having alower transparent conductive film and a lower metal film on an insulative substrate having a light transmission property; removing portions of the lower metal film in pixel areas; forming a lower insulating film and an upper insulating film at least on the emitter electrode lines; removing portions of the upper insulating film and the lower insulating film to form openings therein, and recessing portions of the lower insulating film surrounding the openings by a predetermined amount; forming an upper transparent conductive film and an upper metal film in this order on the resulting substrate; removing portions of the upper metal film in the pixel areas; forming a sacrificial film on the resulting substrate in such a manner that interior surfaces of the openings are not covered with the sacrificial film; depositing an emitter tip material on the resulting substrate to such an extent that the openings are completely covered therewith for formation of emitter tips on the lower transparent conductive film within the openings; removing the sacrificial film and portions of the emitter tip material deposited on the sacrificial film; and processing the upper transparent conductive film and the upper metal film for formation of gate electrode lines.

The emitter tips are conical metal elements each having a sharp tip and formed of a metal selected from the group consisting of nickel, gold, platinum, molybdenum, titanium and tungsten. These metals may be used in combination for formation of emitter tips each having a double layer structure. Typically, 200 to 4,000 emitter tips are provided in each of the pixel areas.

The emitter electrode lines serve as power supply lines to apply a negative voltage (e.g., −40 V) to the emitter tips. The emitter electrode lines are each formed of a conductive film. Particularly in the present invention, portions of the emitter electrode lines in the pixel areas are formed of a transparent conductive film such as an ITO film or a tin dioxide film. The other portions of the emitter electrode lines are preferably formed of a metal conductive film such as of aluminum, molybdenum or titanium having alower resistance. Therefore, the emitter electrode lines preferably each have a double layer structure having a lower layer of the transparent conductive film and an upper layer of the metal film.

The gate electrode lines serve to supply a voltage (e. g., 40 V) for extracting electrons from the emitter tips. The gate electrode lines are each formed of the same material as the emitter electrode lines and preferably have a double layer structure of a transparent conductive film and a metal film. The gate electrode lines extend parallel to each other. The emitter electrode lines also extend parallel to each other. The gate electrode lines cross the emitter electrode lines at the respective pixel areas, typically, at the right angle, so that the pixel areas are arranged in a matrix.

The insulating film is interposed between the emitter electrode lines and the gate electrode lines to establish electrical insulation therebetween. The insulating film has a thickness of about 0.7 $\mu$m.

Examples of the material for the insulating film include silicon dioxide, silicon nitride and tantalum pentoxide, but the material is not limited thereto. The insulating film may have a single layer structure formed of any one of the aforesaid materials, or have a double layer structure. The double layer structure has a lower layer of silicon dioxide and an upper layer of silicon nitride, for example.

The emitter electrode lines, the gate electrode lines and the insulating film can be formed, for example, by a CVD method, a sputtering method or the like.

A thin and planar substrate is used for the cathode plate. The substrate should be transparent so that a user can view the flat display from a side of the substrate opposite to a surface thereof formed with the emitter electrode lines and the like. Examples of the substrate include a glass substrate and the like.

The anode plate is produced by forming the conductive film and the fluorescent layers on a planar substrate. Examples of the material for the substrate of the anode plate include a glass and a ceramic. According to the present invention, the anode substrate is not necessarily required to have a light transmission property. Therefore, the material for the anode substrate is not limited to the aforesaid materials, and the anode substrate may be made of silicon, stainless steel, nickel or the like.

The conductive film for the anode plate serves to supply a positive voltage (e.g., +500 V). The conductive film is formed of a metal such as aluminum, molybdenum or titanium. The fluorescent layers are formed in the pixel areas. Where the flat display is adapted for color display, fluorescent layers of three primary color (red, green and blue) are arranged in a predetermined pattern commonly employed in the art.

The anode plate and the cathode plate are disposed to face opposite to each other with a predetermined spacing (e. g., 200 $\mu$m) kept therebetween. To this end, a plurality of spacers made of a glass or a like material are preferably interposed between the anode plate and the cathode plate.

The plurality of spacers preferably each have a minute cylindrical configuration, and disposed at proper positions between the anode plate and the cathode plate to keep the predetermined spacing therebetween.

The spacers may be formed of the same material as the anode substrate. In such a case, the spacers can be formed integrally with the anode substrate.

The anode plate is preferably formed with through-holes as the ventholes. When electrons emitted from the emitter tips impinge on the fluorescent layers to cause the fluorescent layers to emit excitation light, a gas emanates from the fluorescent layers. The ventholes allow the gas to escape to the rear side of the anode plate. Therefore, the anode plate is preferably formed with as many through-holes as possible.

The through-holes may have any of various configurations such as a circular shape, a rectangular shape and a linear shape in section, but the configuration of the through-holes is not particularly limited thereto. For effective ventilation of the gas, the ratio of the total area of the through-holes to the surface area of the anode plate is preferably as large as possible.

The through-holes are preferably provided adjacent to the pixel areas to keep the pixel areas at a high vacuum level for prevention of destruction of the emitter tips.

The floating electrode portion and the metal film bridge are provided in each of the pixel areas to suppress an influence of a short circuit to be caused between an emitter tip and a gate electrode line. The floating gate electrode portion is formed of the same material as the transparent portions of the gate electrode lines within the pixel areas, i.e., formed of the transparent conductive film.

For isolation of the floating electrode portion from the gate electrode line, a portion of the gate electrode line surrounding an area where the floating electrode portion is to be formed is removed by a predetermined width after the gate electrode line is formed. In other words, a trench having a predetermined width (e.g., 5 $\mu$m) is formed through the thickness of a transparent conductive film of the gate electrode line to surround the area where the floating electrode portion is to be formed to electrically isolate the floating electrode portion from the other portion of the gate electrode line.

The floating electrode portion may have dimensions to embrace all the emitter tips provided within one pixel area. Alternatively, the emitter tips provided Within one pixel area may be divided into several blocks, so that the floating electrode portion has dimensions to embrace each of the emitter tip blocks. That is, a plurality of floating electrode portions may be provided within a single pixel area.

The metal film bridge, which serves to electrically connect the floating electrode portion to the gate electrode line, is formed of the same material as the gate electrode metal film, i.e., formed of titanium and the like. At least one metal film bridge is formed to bridge the trench isolating the floating electrode portion from the gate electrode line.

The metal film bridge serves as a so-called fuse. Therefore, the metal film bridge preferably has a small width so as to be fused down when an emitter tip is short-circuited with an adjacent floating electrode portion and a short-circuit current flows through the metal film bridge. For example, the metal film bridge has a width of about 1 $\mu$m.

As described above, the flat display of the present invention includes the rear plate provided with the getter. Exemplary materials for the rear plate include insulative materials such as a glass and a ceramic, and conductive materials such as silicon, stainless steel and nickel.

Spacers are preferably provided between the rear plate and the anode plate to form a gap for accommodating the getter between a surface of the rear plate and the anode plate.

As described above, a gas emanates from the fluorescent layers when excitation light is emitted from the fluorescent layers on the surface of the anode plate. The anode plate and the rear plate are arranged so that a sufficient ventilation space can be formed between the cathode plate and the getter to allow the gas to escape toward the getter formed on the rear plate. The through-holes formed in the anode plate serve as the ventilation space.

Usable as the getter are a non-evaporation type thin getter plate and an evaporation type getter to be applied on the rear plate.

The getter preferably has a large surface area for efficient adsorption of the gas. A great amount of the getter is preferably provided on a surface portion of the rear plate where the spacers are not formed.

For reduction of the thickness of the flat display, thin getter plates are preferably used. Alternatively, ventilation glass tubes charged with the getter may be used.

In accordance with the present invention, the flat display employing the minute field emission cathode permits light emission from the fluorescent layers to be viewed from the front side of fluorescent layers, i.e., from the rear side of the cathode plate. This is achieved by allowing the emitter electrode lines and the gate electrode lines to have transparent portions formed of the transparent conductive film at least in the pixel areas.

Further, the flat display of the present invention has an improved ventilation efficiency for ventilating the gas emanating from the fluorescent layers and the like. This is achieved by providing the getter on the rear side of the anode plate. This arrangement facilitates the formation of the fluorescent layers and the spacers.

The flat display of the present invention will hereinafter be described in detail by way of embodiments thereof with reference to the attached drawings. It should be noted, however, that these embodiments are not limitative of the invention.

First Embodiment

FIG. 1 is a partial view schematically illustrating the construction of a cathode plate of a flat display according to the present invention.

As shown, the cathode plate includes a field emission cathode disposed on a glass substrate (not shown) and having emitter tips 1, gate electrode lines 2 and emitter electrode lines 3.

The gate electrode lines 2 are disposed in an orthogonal relation with respect to the emitter electrode lines 3 with an insulating film (not shown) interposed therebetween. Several hundred emitter tips 1 are provided in each of areas where the gate electrode lines intersect the emitter electrode lines. The intersection areas each define a pixel. In FIG. 1, only four emitter tips 1 are shown within each pixel for convenience of illustration.

In this embodiment, the gate electrode lines 2 and the emitter electrode lines 3 each comprise two layers of a metal film (shaded portions in FIG. 1) and a transparent conductive film 4. The gate electrode lines 2 and the emitter electrode lines 3 each have transparent portions formed of the transparent conductive film 4 alone in pixel areas where the emitter tips 1 are provided within the intersection areas. The metal films ensure the conductivity of the electrode lines.

Where the gate electrode lines 2 and the emitter electrode lines 3 each have a width of 250 $\mu$m, the transparent portions 4 of the transparent conductive film within the pixel areas each have dimensions of about 200 $\mu$m×200 $\mu$m.

Figure 2:
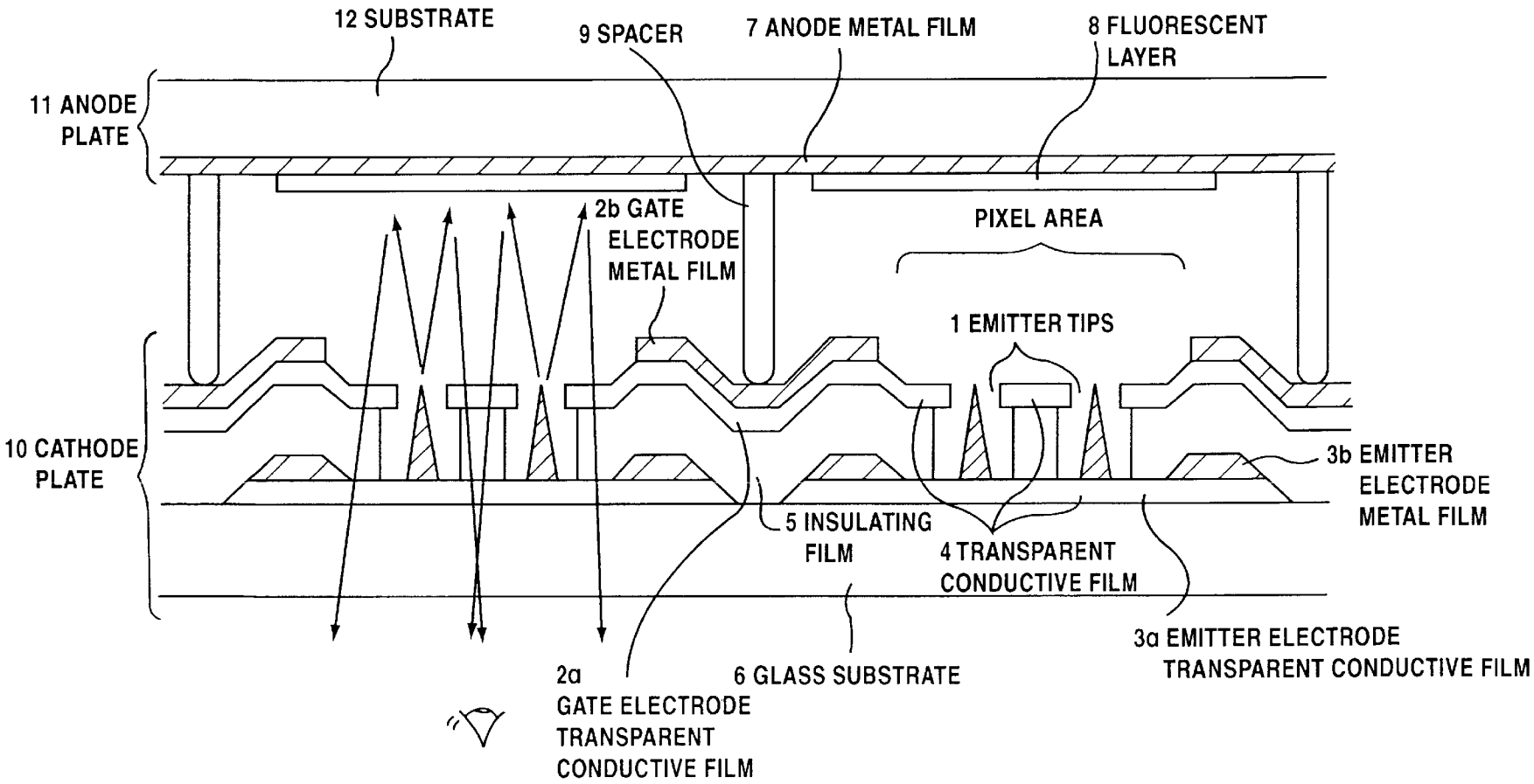
FIG. 2 is a sectional view illustrating the cathode plate according to the first embodiment.

FIG. 2 is a sectional view of the flat display including the aforesaid cathode plate according to the first embodiment. The sectional view is taken along the section line in FIG. 1.

As previously stated, the cathode plate 10 includes the glass substrate 6, the emitter tips 1, the emitter electrode lines 3, the gate electrode lines 2 and the insulating film 5. The emitter electrode lines 3 each extend in a direction perpendicular to the paper face of FIG. 2, while the gate electrode lines 2 each extend laterally of the paper face of FIG. 2.

The emitter electrode lines 3 each comprise a transparent conductive film 3*a* and a metal film 3*b*, and the gate electrode lines 2 each comprise a transparent conductive film 2*a* and a metal film 2*b*. The metal films 2*b* and 3*b* are not present within the pixel areas in which the emitter tips 1 are provided.

An anode plate 11 includes a substrate 12 of a ceramic or a glass, an anode metal film 7 formed on the substrate 12, and fluorescent layers 8 each formed on the metal film 7 in a position facing opposite to a pixel area of the cathode plate 10.

The cathode plate 10 and the anode plate 11 are spaced a predetermined distance (about 100 μm to about 200 μm) with spacers 9 interposed therebetween. The cathode plate 10 and the anode plate 11 are fixed to each other with peripheral portions of the substrates thereof sealed with a frit glass.

When a voltage of about 500 V is applied to the anode metal film 7 with a voltage of −40 V applied to the emitter electrode lines 3 and with a voltage of 40 V applied to the gate electrode lines 2, electrons are emitted from the emitter tips 1 toward the anode plate metal film 7.

The emitted electrons impinge on the fluorescent layers 8 from which excitation light is emitted. A user views the excitation light through the transparent conductive film portions of the gate electrode lines 2 and the emitter electrode lines 3 and the glass substrate of the cathode plate from the lower side of FIG. 2. Since the light emission from the fluorescent layers is directly viewed, the flat display ensures highly luminous display.

The flat display of the first embodiment shown in FIG. 2 has a thickness of about 200 μm as measured between the opposed surfaces of the glass substrate of the cathode plate and the substrate of the anode plate, with the thickness of the glass substrate 6 being 500 μm, the thickness of the emitter electrode transparent conductive film (ITO film) 3*a* being 0.2 μm, the thickness of the emitter electrode metal film (aluminum film) 3*b* being 0.2 μm, the thickness of the insulating film (silicon dioxide) 5 being 0.7 μm, the thickness of the gate electrode transparent conductive film (ITO film) 2*a* being 0.3 μm, the thickness of the gate electrode metal film (titanium film )2*b* being 0.2 μm, the thickness of the spacers 9 being 200 μm, the thickness of the fluorescent layers being 20 μm, the thickness of the substrate 12 of the anode plate 11 being 500 μm, and the thickness of the anode plate metal film 7 being 0.2 μm.

The emitter tips 1 are formed of nickel or molybdenum and do not have a light transmission property. The emitter tips 1 each have a bottom face diameter of about 0.7 μm and a height of about 1 μm, which are significantly smaller than the dimensions (200 μm×200 μm) of the pixel area. Therefore, the emitter tips 1 do not interfere with the transmission of the excitation light from the fluorescent layers.

In reality, the flat display of the aforesaid construction exhibits a luminance of about 300 cd/m$^2$, which is about twice as high as that of the prior art display device constructed such that the emission light is viewed through the anode plate.

The substrate 12 of the anode plate 11 may be a glass substrate as used conventionally. However, the substrate 12 is not necessarily required to have a light transmission property, because the display device of the present invention is constructed such that the emission light is viewed through the cathode plate. Therefore, the substrate 12 of the anode plate 11 may be formed of a ceramic which does not have a light transmission property. The spacers 9 can be formed of the same material as the substrate 12 integrally with the substrate 12.

Since the rear side of the anode plate 12 (the upper portion of FIG. 2) is not concerned with display, a getter can be provided on the rear side of the substrate of the anode plate.

The provision of the getter allows the inside of the flat display to be constantly kept at a high vacuum level, so that the flat display can have an improved stability and an extended lifetime. In addition, the display area of the flat display can be increased. The construction of the flat display having the getter provided on the rear side of the anode plate will be described later.

An explanation will next be given to a process for producing the cathode plate according to the first embodiment of the present invention.

FIGS. 12(*a*) to 12(*i*) are schematic diagrams for explaining the process for producing the cathode plate according to the first embodiment.

As shown in FIG. 12(*a*), a 0.2-μm thick ITO film is formed on a glass substrate 6 by a sputtering method, and patterned to form the transparent conductive films 3*a* of the emitter electrode lines 3.

As shown in FIG. 12(*b*), a 0.2-μm thick titanium film is formed on the resulting substrate and patterned by a photolithography method to form the metal films 3*b* of the emitter electrode lines 3 and windows in pixel areas.

As shown in FIG. 12(*c*), a 0.7-μm thick silicon dioxide (for the insulating film 5), 0.2-μm thick ITO film (for the transparent conductive films 2*a* of the gate electrode lines 2) and 0.2-μm thick titanium film (for the metal films 2*b* of the gate electrode lines 2) are successively formed on the resulting substrate. The formation of the silicon dioxide film is achieved by a plasma CVD method, and the formation of the ITO film and the titanium film is achieved by a sputtering method.

As shown in FIG. 12(*d*), the titanium film 2*b* is patterned by a photolithography method to form windows in the pixel areas.

As shown in FIG. 12(*e*), the ITO film 2*a* and the silicon dioxide film 5 are etched for formation of circular gate openings each having a diameter of 1 μm. Then, the silicon dioxide film 5 is selectively wet-etched with hydrofluoric acid so as to be recessed by 0.2 μm.

As shown in FIG. 12(*f*), magnesium oxide is obliquely deposited to a thickness of 0.4 μm on the resulting substrate to form a sacrificial film 53. The oblique deposition prevents magnesium oxide from covering interior portions of the gate openings.

As shown in FIG. 12(*g*), an emitter tip material (nickel or molybdenum) 54 is deposited to a thickness of 1 μm on the resulting substrate to cover the gate openings therewith. Thus, the emitter tips 1 are formed on the transparent conductive films 3*a* within the gate openings.

As shown in FIG. 12(*h*), the sacrificial film 53 of magnesium oxide is dissolved to lift off the emitter tip material 54 deposited on the top of the sacrificial film 53.

As shown in FIG. 12(*i*), the titanium film 2*b* and the ITO film 2*a* for the gate electrode lines 2 are patterned to form the gate electrode lines 2.

Thus, the cathode plate 10 of the first embodiment is completed.

In terms of processability, it is preferred to use an ITO film for the formation of the transparent conductive films 2*a* and 3*a*. Alternatively, a tin dioxide film or the like may be used as previously described.

The materials for the metal films 2*b* and 3*b* are not particularly limited, and aluminum, molybdenum or the like may otherwise be used. Further, silicon nitride may otherwise be used as the material for the insulating film 5.

Second Embodiment

Figure 3:
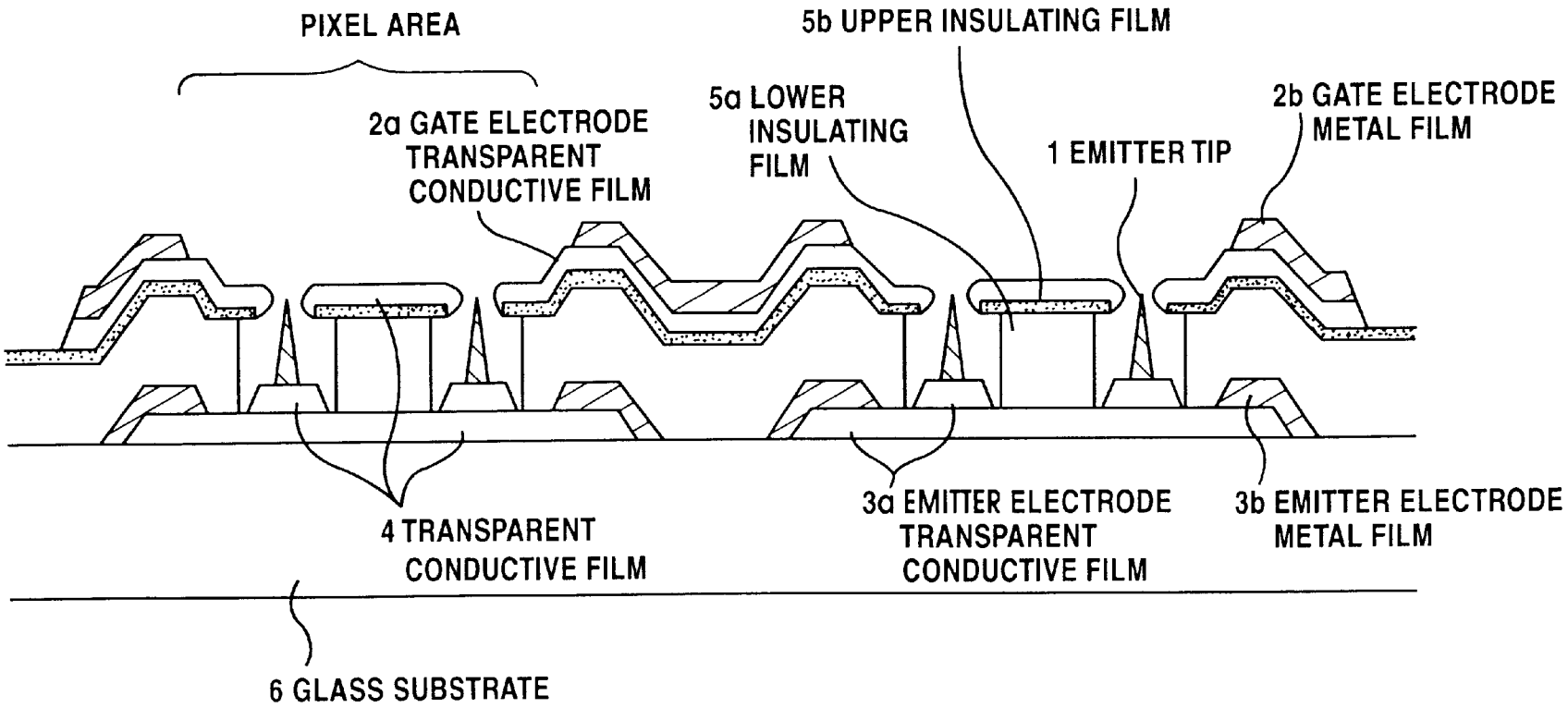
FIG. 3 is a sectional view illustrating a cathode plate according to a second embodiment of the present invention.

FIG. 3 is a sectional view of a cathode plate according to a second embodiment of the present invention.

Like the first embodiment shown in FIG. 2, the cathode plate of the second embodiment is constructed such that the gate electrode lines 2 and the emitter electrode lines 3 each have transparent portions formed of a transparent conductive film in the pixel areas. The second embodiment is different from the first embodiment in that the transparent conductive films 3*a* of the emitter electrodes lines 3 partially has a double layer structure and the insulating film 5 has a double layer structure (a lower insulating film 5*a* and an upper insulating film 5*b*).

FIGS. 13(*a*) to 13(*j*) are schematic diagrams for explaining a process for producing the cathode plate of the second embodiment.

In the same manner as in the first embodiment, a 0.2-μm thick ITO film is formed on a glass substrate and patterned to form lower layer transparent conductive films 3*a* of the emitter electrode lines 3, as shown in FIG. 13(*a*).

As shown in FIG. 13(*b*), a 0.2-μm thick titanium film is formed on the resulting substrate and patterned to form metal films 3*b* of the emitter electrode lines 3 and windows in pixel areas.

As shown in FIG. 13(*c*), a 0.7-μm thick silicon dioxide (for the lower insulating film 5*a*) and 0.1-μm thick silicon nitride film (for the upper insulating film 5*b*) are successively formed on the resulting substrate, unlike the first embodiment. The formation of the silicon dioxide film and the silicon nitride film is achieved by a plasma CVD method.

As shown in FIG. 13(*d*), the silicon dioxide film 5*a* and the silicon nitride film 5*b* are etched for formation of circular gate openings each having a diameter of 1 μm. Then, the silicon dioxide film 5*a* is selectively wetetched with hydrofluoric acid so as to be recessed by 0.2 μm.

As shown in FIG. 13(*e*), a 0.2-μm thick ITO film 52 and a 0.2-μm thick titanium film 51 are successively formed on the resulting substrate.

As shown in FIG. 13(*f*), portions of the titanium film 51 in the pixel areas are selectively wet-etched. At this time, portions of the titanium film 51 deposited in the gate openings are removed so that portions of the ITO film 52 are exposed which serve as an upper layer transparent conductive film 3*a* of the emitter electrode lines 3.

As shown in FIG. 13(*g*), magnesium oxide is obliquely deposited to a thickness of 0.4 μm on the resulting substrate to form a sacrificial film 53.

As shown in FIG. 13(*h*), an emitter tip material (nickel or molybdenum) 54 is deposited to a thickness of 1 μm on the resulting substrate to cover the gate openings therewith for formation of emitter tips 1.

As shown in FIG. 13(*i*), the sacrificial film 53 of magnesium oxide is dissolved to lift off the emitter tip material 54 deposited on the top of the sacrificial film 53.

As shown in FIG. 13(*j*), the titanium film 51 and the ITO film 52 for the gate electrode lines 2 are patterned to form the gate electrode lines 2 each including a transparent conductive film 2*a* and a metal film 2*b*.

Thus, the cathode plate of the second embodiment is completed.

In the second embodiment, the number of the process steps is increased (steps of FIGS. 13(*c*) and 13(*d*)) because the double layer insulating film is formed. However, the second embodiment is advantageous in that the production process is simplified because there is no need to pattern-etch the ITO film 2*a* (for the gate electrode transparent conductive films) to form micron-size gate openings therein in the steps of FIGS. 12(*d*) and 12(*e*) in the production process of the first embodiment.

Third Embodiment

Figure 4:
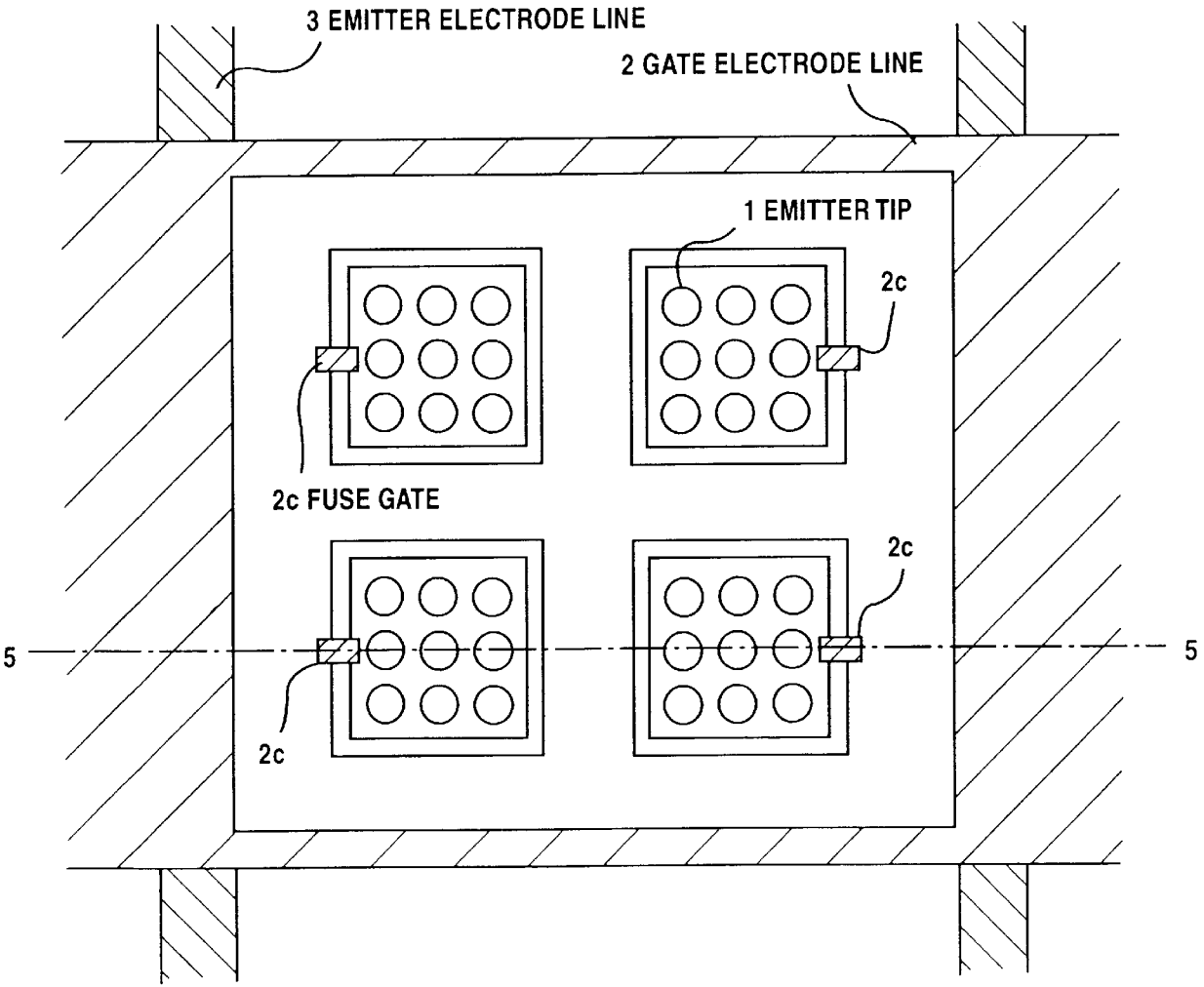
FIG. 4 is a diagram illustrating the construction of a cathode plate formed with metal film bridges (fuse gates) according to a third embodiment of the present invention.
Figure 5:
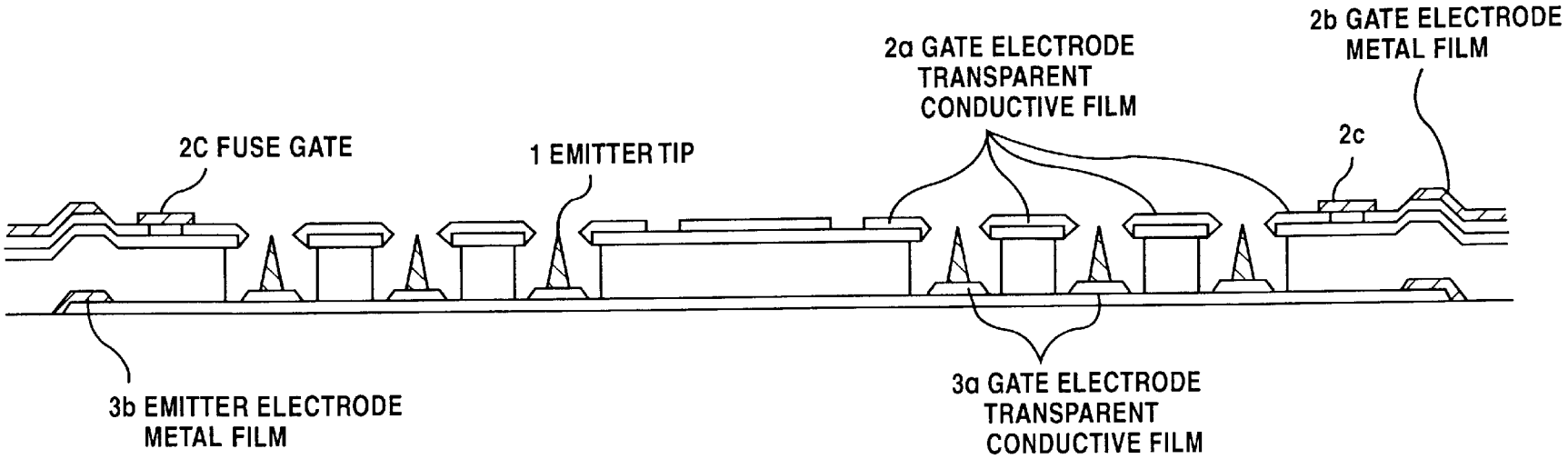
FIG. 5 is a sectional view of the cathode plate according to the third embodiment.

FIGS. 4 and 5 illustrate the construction of a cathode plate having metal film bridges (hereinafter referred to as "fuse gates") provided in a gate electrode line thereof in a pixel area. FIG. 4 is a plan view illustrating a pixel area and its peripheral area, and FIG. 5 is a sectional view taken along a line A–A' in FIG. 4.

The fuse gates 2*c* ensure redundancy for protection against a defect resulting from a short circuit between an emitter tip 1 and agate electrode line 2. When a short circuit occurs between an emitter tip 1 and a gate electrode line 2 due to contamination with dust during the production process or discharge break-down during activation of the emitter tip, an emitter electrode line 1 connected to the emitter tip 3 has the same potential as the gate electrode line 2, hindering the other normal emitter tips 1 from operating properly.

In view of this, emitter tips 1 in a single pixel are divided into a plurality of blocks, and a floating gate electrode portion is provided in each of the emitter tip blocks and connected to a gate electrode line via a fuse gate 2*c*. With this arrangement, when a short-circuit current flows through the fuse gate 2*c*, the fuse gate 2*c* is fused down to electrically isolate the short-circuited emitter tip block from the other blocks.

The fuse gates 2*c* have a width of 1 μm, and a length of about 5 μm for connecting the floating gate electrode portion to the gate electrode line.

In the production process for the cathode plate, the fuse gates 2*c* are formed when the ITO film 52 and the titanium film 51 are formed (in the step of FIG. 13(*e*)) and patterned (in the steps of FIGS. 13(*f*) and 13(*j*)) for the formation of the gate electrode lines.

More specifically, when the portions of the titanium film 51 (for the gate electrode metal films 2*b*) in the pixel areas are removed in the step of FIG. 13(*f*), portions of the titanium film 51 in areas where the fuse gates 2*c* are to be formed are left within the pixel areas as shown in FIG. 4.

Thereafter, the emitter tips 1 are formed in the same manner as in the second embodiment in the steps of FIGS. 13(*g*) to 13(*i*). When the ITO film 52 (for the gate electrode transparent conductive film 2*a*) is patterned by wet-etching in the step of FIG. 13(*j*), trenches are formed through the thickness of the ITO film 52 so as to surround the respective emitter tip blocks. Thus, floating gate electrode portions are formed.

At this time, portions of the ITO film 52 under the remaining metal film portions (formed in the step of FIG. 13(*f*)) in the gate fuse formation areas are under-etched for removal thereof.

As a result, cavities are formed under the remaining metal film portions so that the fuse gates 2*c* overhang as shown in FIG. 5.

Fourth Embodiment

Figure 6:
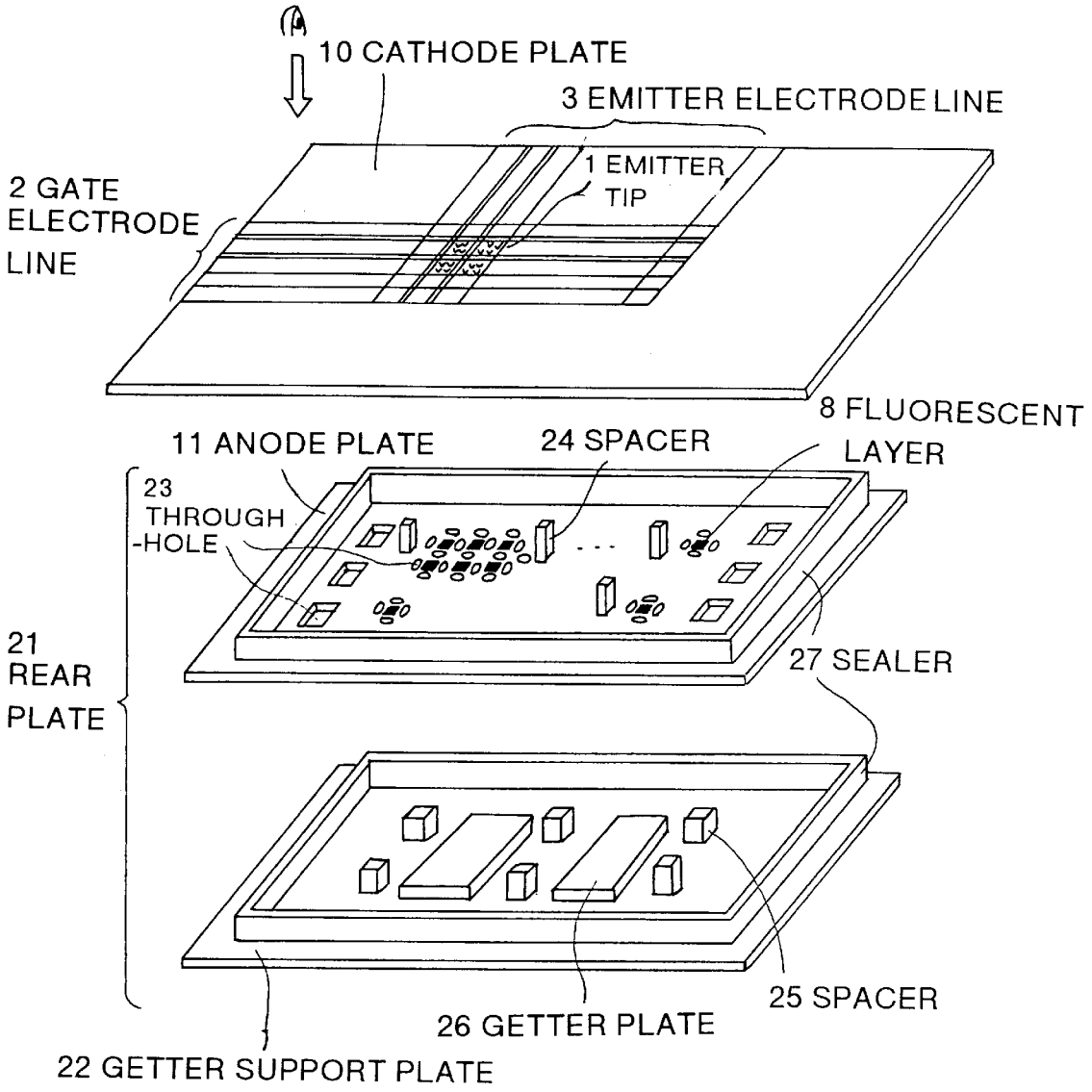
FIG. 6 is a diagram illustrating the construction of a flat display according to a fourth embodiment of the present invention.

FIG. 6 is a diagram illustrating the construction of a flat display provided with a getter plate in accordance with the present invention.

The flat display includes a cathode plate 10 and a rear plate 21 which comprises an anode plate 11 and a getter support plate 22 provided with getter plates 26.

The cathode plate shown in FIG. 2 or 3 may be used as the cathode plate 10. A user views light emission from fluorescent layers through the cathode plate 10 from the top side of FIG. 6.

The anode plate 11 includes a substrate made of a ceramic and the like, a sealer 27 provided on a peripheral portion of the substrate to surround a display area, and through-holes 23 and spacers 24 provided in non-pixel areas in the display area.

The anode plate 11 further includes fluorescent layers 8 formed thereon in positions corresponding to the pixel areas of the cathode plate 10.

When electrons emitted from the emitter tips 1 impinge on the fluorescent layers 8, the through-holes 23 allow a gas emanating from the fluorescent layers 8 to escape toward the side of the getter support plate 22. The configuration of the through-holes 23 is not particularly limited, but the total area of the through-holes 23 formed in the anode plate is preferably as large as possible to allow the gas to efficiently escape therefrom. The through-holes 23 are preferably provided adjacent to the pixel areas as shown in FIG. 6.

The sealer 27 is of a glass or a resin of a low melting point. The cathode plate 10 is bonded to the anode plate 11 with the sealer 27 melted at about 440° C. so that a closed space is defined therebetween. The spacers 24 are made of a glass or a like material, and has a height of about 200 $\mu$m.

The getter support plate 22 includes a substrate of a glass, aceramic or a like material, and thin getter plates 26 made of zirconium or a like material, spacers 25 and a sealer 27 which are provided on the substrate.

A non-evaporation type getter is generally used for the getter plates 26, but an evaporation type getter such as of barium deposition film may be used. Where non-evaporation type getter plates 26 are employed, the getter plates are fixed on the substrate with a silver paste.

The spacers 25 are made of the same material as the spacers 24, and each have a height of about 250 $\mu$m. The getter plates each have a height of about 120 $\mu$m.

The getter plates 26 are disposed in a region surrounded by the sealer 27 and not provided with the spacers 25. For efficient adsorption of the gas ventilated through the through-holes 23, the total surface area of the getter plates is preferably as large as possible. The configuration of the getter plates is not limited to a planar rectangular shape as shown in FIG. 6. A greater number of getter plates are preferably provided to cover the surface of the substrate not provided with the spacers 25.

Since some of the through-holes 23 are provided in positions adjacent to the fluorescent layers 8 on the anode plate 11, the gas emanating from the fluorescent layers 8 when emitted electrons impinge thereon is ventilated through the through-holes 23 and directed toward the getter plates.

The provision of the through-holes 23 and the getter plates 26 makes it possible to constantly maintain ambient environment around the emitter tips 1 in the pixel areas at a high vacuum level thereby to extend the lifetime of the flat display.

Figure 7:
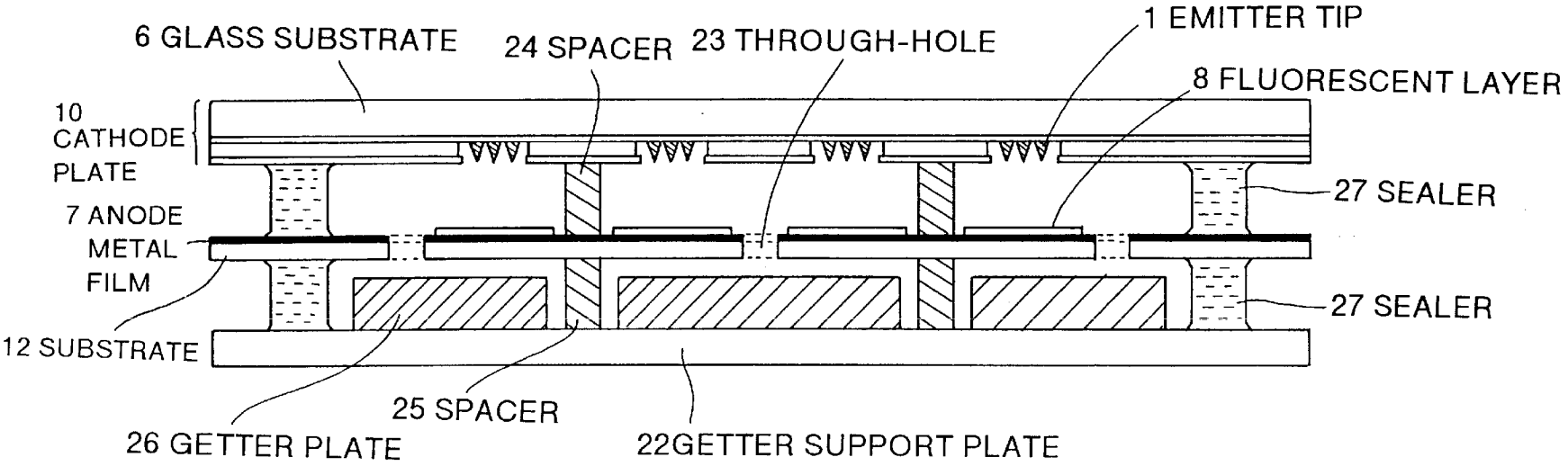
FIG. 7 is a sectional view of the flat display according to the fourth embodiment.

FIG. 7 is a sectional view of the flat display shown in FIG. 6.

As shown, the anode plate 11 includes a metal conductive film 7 provided on the substrate for power supply to the anode plate, the fluorescent layers 8 provided on the substrate 12 in the pixel areas, and the through-holes 23 formed in the substrate 12 in non-pixel areas adjacent to the fluorescent layers 8.

The flat display of FIG. 7 is produced in the following manner.

A photosensitive glass substrate is used as the substrate 12 for the anode plate 11. A mask for through-hole formation is laid on the photosensitive glass substrate 12, and the through-holes 23 are formed in non-pixel areas in the photosensitive glass substrate 12 by light exposure and etching processes. The anode metal conductive film 7, the fluorescent layers 8 and the spacers 24 are formed in predetermined positions on the photosensitive glass substrate 12. The sealer 27 (such as of a low melting point glass) is applied on a peripheral portion of the glass substrate 12. Thus, the anode plate is produced.

A glass substrate is used as the getter support plate 22. The getter plates 26 and the spacers 25 are fixed in predetermined positions on the getter support plate 22. More specifically, the spacers 25 are formed of a glass by screen printing. The getter plates 26, for example, made of st122 available from Seas Getters are fixed on the getter support plate 22 with a silver paste. Thereafter, the sealer 27 (such as of a low melting point glass) is applied on a peripheral portion of the getter support plate 22 around the display area.

In turn, the cathode plate 10, the anode plate 11 and the getter support plate 22 are put in a vacuum vessel at a vacuum level of $1\times10^{-7}$ Torr, and the getter support plate 22 is heated at a temperature of higher than 350° C. Thus, the getter plates 26 are activated and start adsorbing ambient gas. The cathode plate 10 and the anode plate 11 are heated at 300° C. for degassing the fluorescent layers and the sealer. Then, the anode plate 11 and the getter support plate 22 are combined with each other in the vacuum vessel, and bonded to each other at 440° C. with a load applied thereto. Subsequently, the cathode plate 10 is bonded to the anode plate 11 at 400° C. with a load applied thereto. Thus, the flat display is completed.

Instead of the non-evaporation type getter plates, an evaporation type getter such as of barium may be used as the getter. In such a case, the evaporation type getter is deposited to a thickness of about 1 $\mu$m on the getter support plate 22 in the vacuum vessel for formation of getter films. Then, the resulting getter support plate 22 is bonded to the anode plate 11 with the sealer 27. Alternatively, no spacer is provided on the getter support plate 22, and getter plates are provided all over the getter support plate 22 within the display area surrounded by the sealer. Further, the evaporation type getter may be deposited on the rear face of the anode plate in the vacuum vessel for formation of a getter film before the anode plate is bonded to the getter support plate. In such a case, the getter film is formed on side walls of the through-holes in the anode plate as well as on the rear face of the anode plate, so that the gas ventilation efficiency is improved.

The flat display thus produced in accordance with the fourth embodiment has a thickness of about 2 mm as measured from the cathode plate 11 to the getter support plate 22.

Since the getter plates are provided on the rear side of the anode plate, the flat display of the present invention provides for a thin display panel with a large display area.

Even if the flat display has a large display area, the vacuum level inside the flat display can be kept high because the getter plates are provided to cover almost all the display area. Further, since many through-holes are provided adjacent to the pixel areas in the anode plate, the gas emanating from the fluorescent layers and the like can promptly be ventilated through the through-holes, whereby the destruction of the emitter tips can be prevented to extend the lifetime of the flat display.

Figure 8:
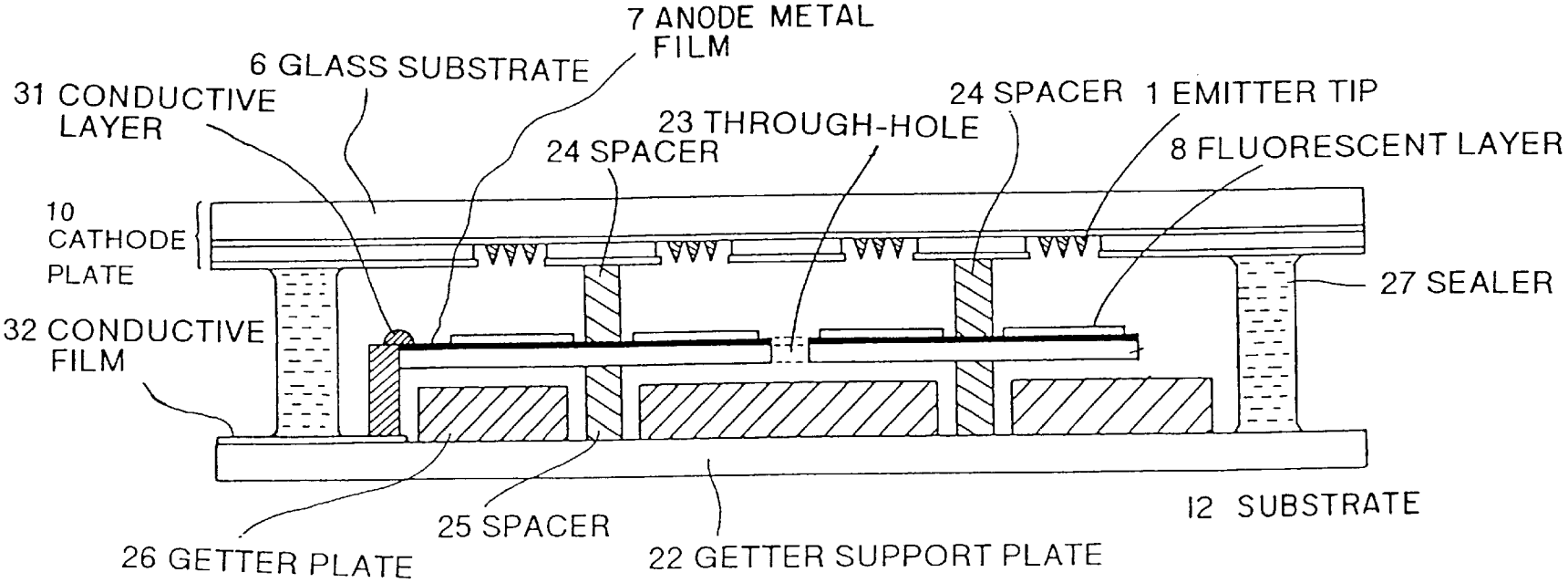
FIG. 8 is a sectional view illustrating a variation of the flat display according to the fourth embodiment.

Although the anode plate 11 has substantially the same dimensions as the getter support plate 22 in the flat display shown in FIG. 7, the anode plate 11 may have such dimensions that the anode plate 11 can be held within a space defined between the cathode plate 10 and the getter support plate 22 and surrounded by the sealer 27 as shown in FIG. 8.

With this arrangement, the ventilation space through which the gas emanating from the fluorescent layers and the like is ventilated can be expanded to improve the gas ventilation efficiency.

Where the construction shown in FIG. 8 is employed, the power supply to the anode plate 11 may be achieved by providing a conductor 31 on one edge of the anode plate and connecting the conductor 31 to the conductive film 32 on the getter support plate 22.

The spacers 24 may be formed integrally with the anode plate 11.

Figure 9A:
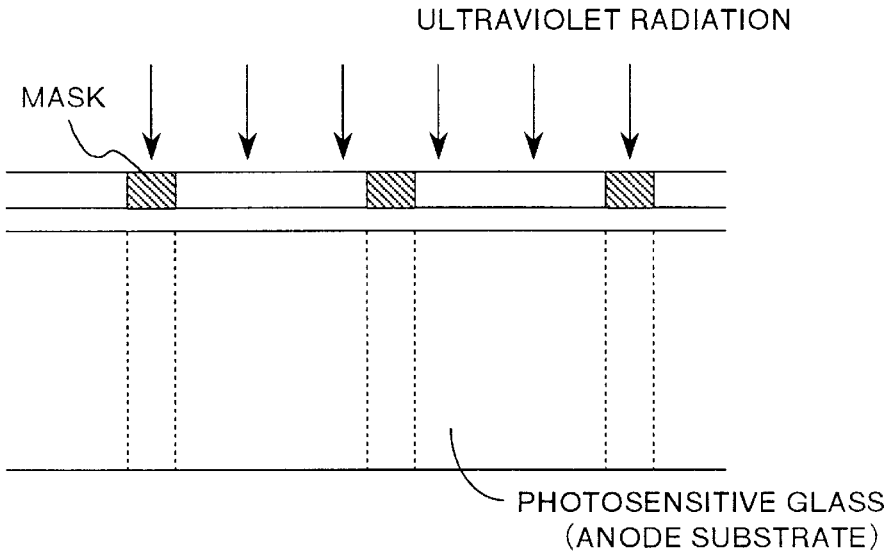
FIGS. 9(*a*) and 9(*b*) are sectional views of one exemplary anode plate according to the present invention.
Figure 9B:
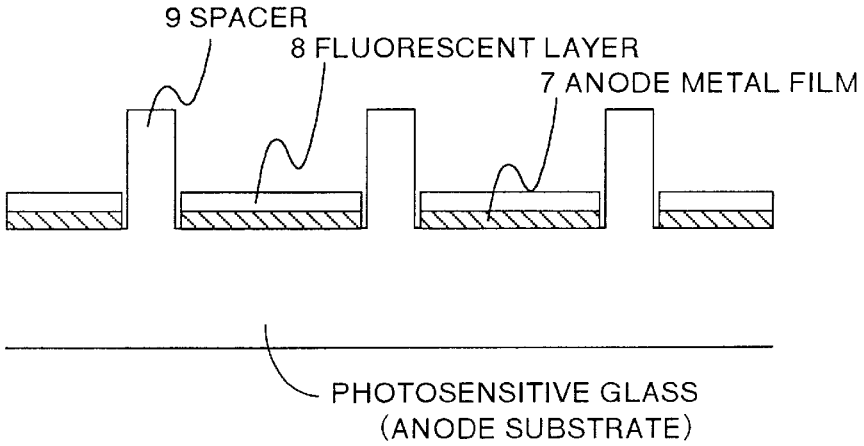

FIGS. 9(*a*) and 9(*b*) are sectional views of one exemplary anode plate 11 for use in the present invention. A photosensitive glass substrate is used as the substrate for the anode plate 11 as described above. A mask for spacer patterning is laid on the glass substrate, which is exposed and developed (FIG. 9(*a*)). The glass substrate is etched to such an extent that the spacers have a predetermined height (e.g., 200 $\mu$m), and then baked for crystallization thereof. Thereafter, anode electrode metal conductive film 7 and fluorescent layers 8 are formed in the pixel areas. Thus, the anode plate having the spacers integrally formed therewith is completed (FIG. 9(*b*)).

With this arrangement, the positioning accuracy of the spacers is improved, facilitating the production of the anode plate.

Figure 10:
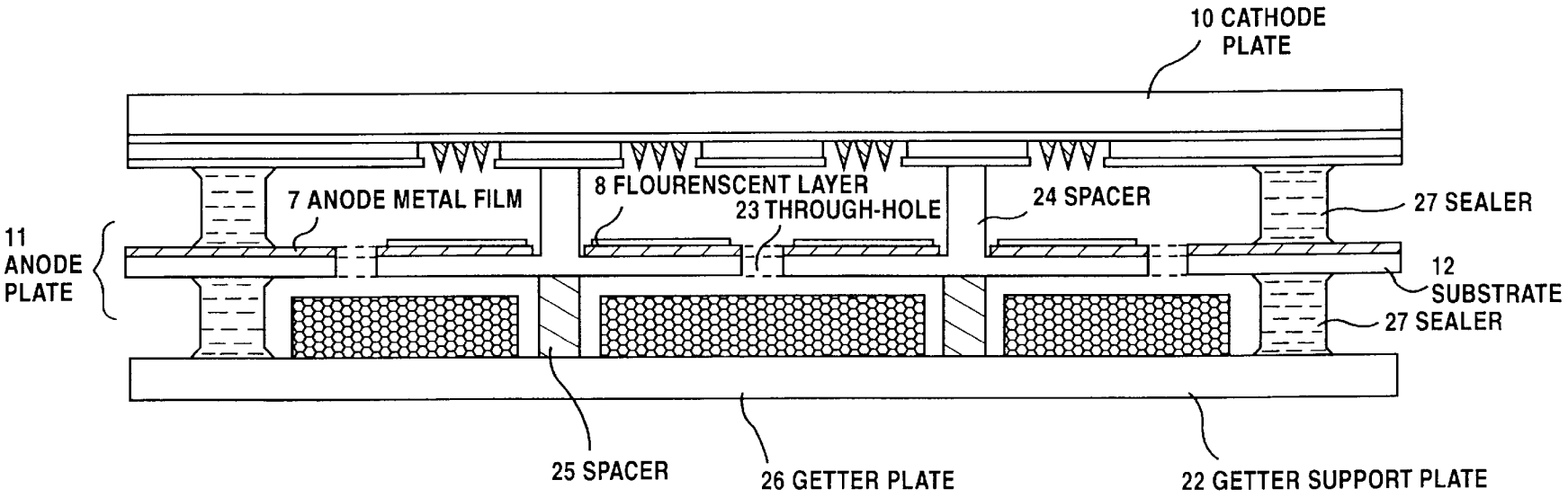
FIG. 10 is a sectional view of a flat display employing the anode late shown in FIG. 9(*b*)

FIG. 10 is a sectional view of a flat display employing the anode plate shown in FIG. 9(*b*). As described above, the spacers 24 are formed integrally with the photosensitive glass substrate 12 of the anode plate 11. Through-holes 23 are formed simultaneously with the formation of the spacers 24. For formation of the through-holes 23 and the spacers 24, the glass substrate 12 is exposed and developed, and etched with hydrofluoric acid. Then, the anode metal film 7 is formed on the glass substrate 12 by sputtering.

In turn, portions of the metal film formed on the spacers 24 are etched off by photolithography. Photosensitive fluorescent substances are applied in predetermined positions on the resulting substrate for formation of fluorescent layers 8. Portions of the fluorescent layers formed on the spacers 24 are etched off by photolithography.

The thus prepared anode plate 11 with the integrally formed spacers is bonded to a getter support plate 22 having getter plates with a sealer 27, and then bonded to a cathode plate 10 with a sealer 27. Thus, the flat display is completed.

Fifth Embodiment

Figure 11:
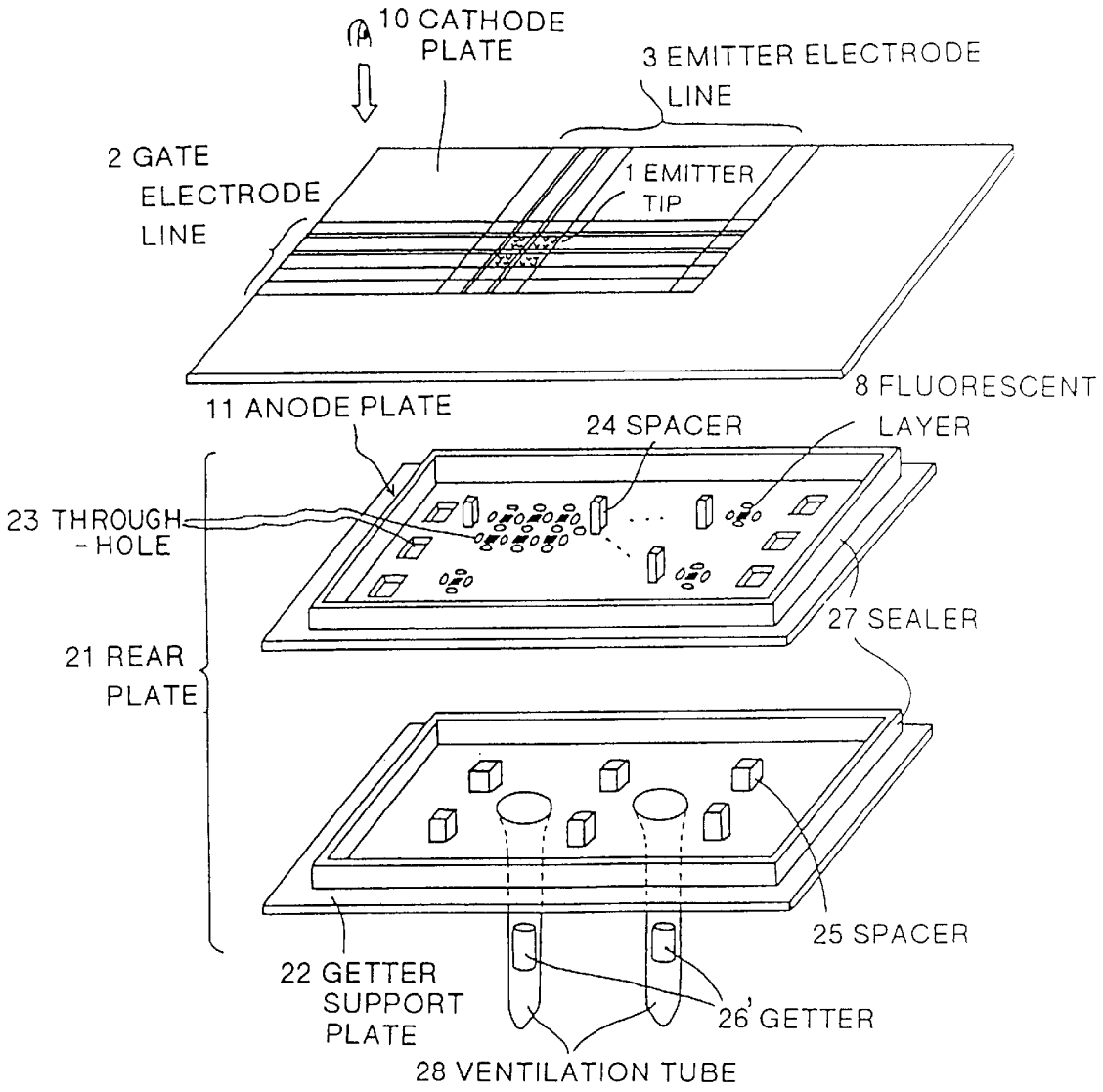
FIG. 11 is a diagram illustrating the construction of a flat display according to a fifth embodiment of the present invention.
Figure 12A:
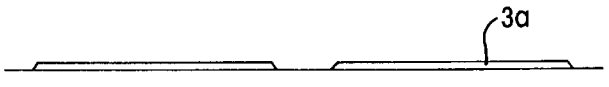
FIGS. 12(*a*) to 12(*i*) are diagrams for explaining a process for producing the cathode plate of the first-embodiment.
Figure 12B:
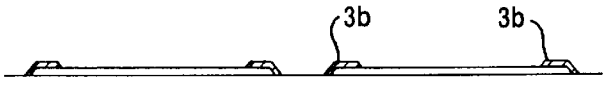
Figure 12C:
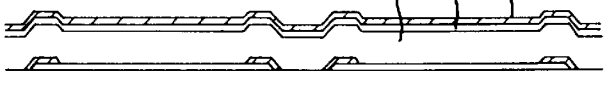
Figure 12D:
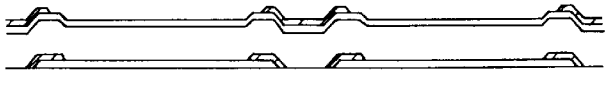
Figure 12E:
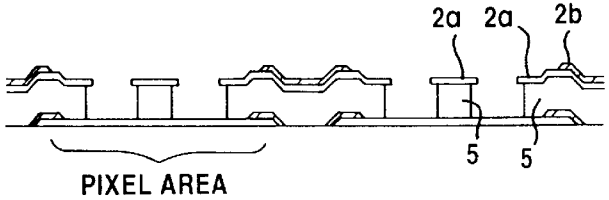
Figure 12F:
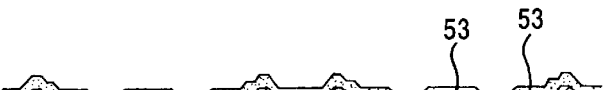
Figure 12G:
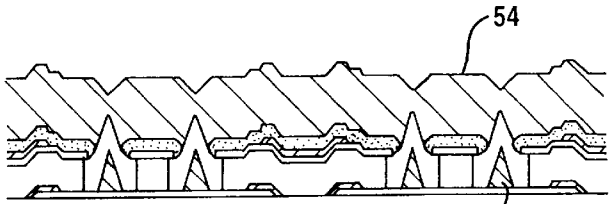
Figure 12H:
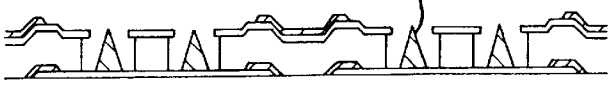
Figure 12I:
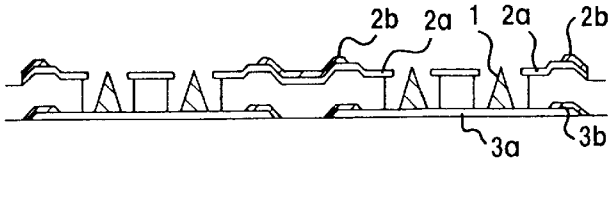
Figure 13A:
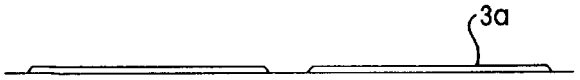
FIGS. 13(*a*) to 13(*j*) are diagrams for explaining a process for producing the cathode plate of the second embodiment.
Figure 13B:
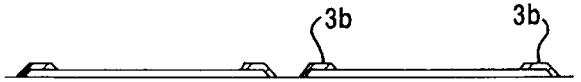
Figure 13C:
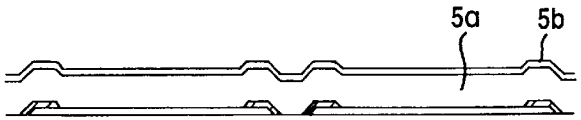
Figure 13D:
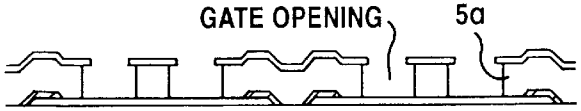
Figure 13E:
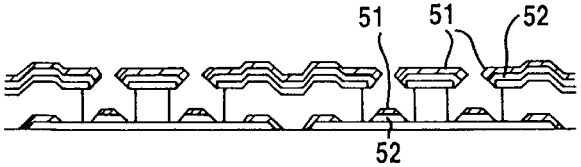
Figure 13F:
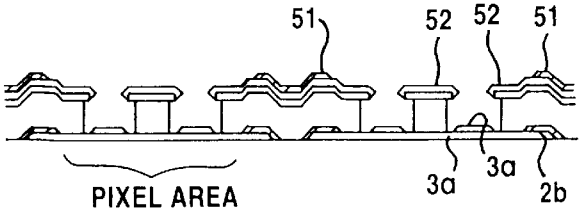
Figure 13G:
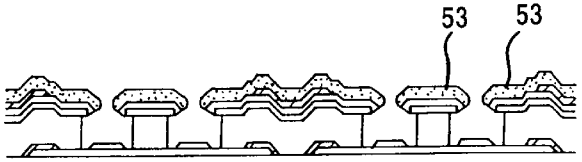
Figure 13H:
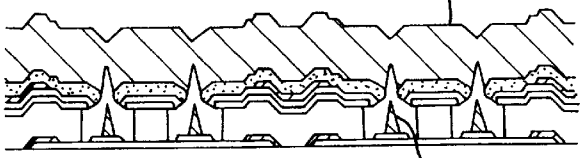
Figure 13I:
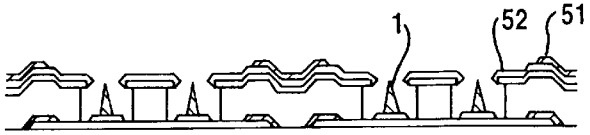
Figure 13J:
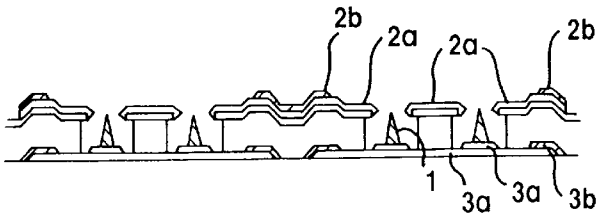
Figures 14, 14A:
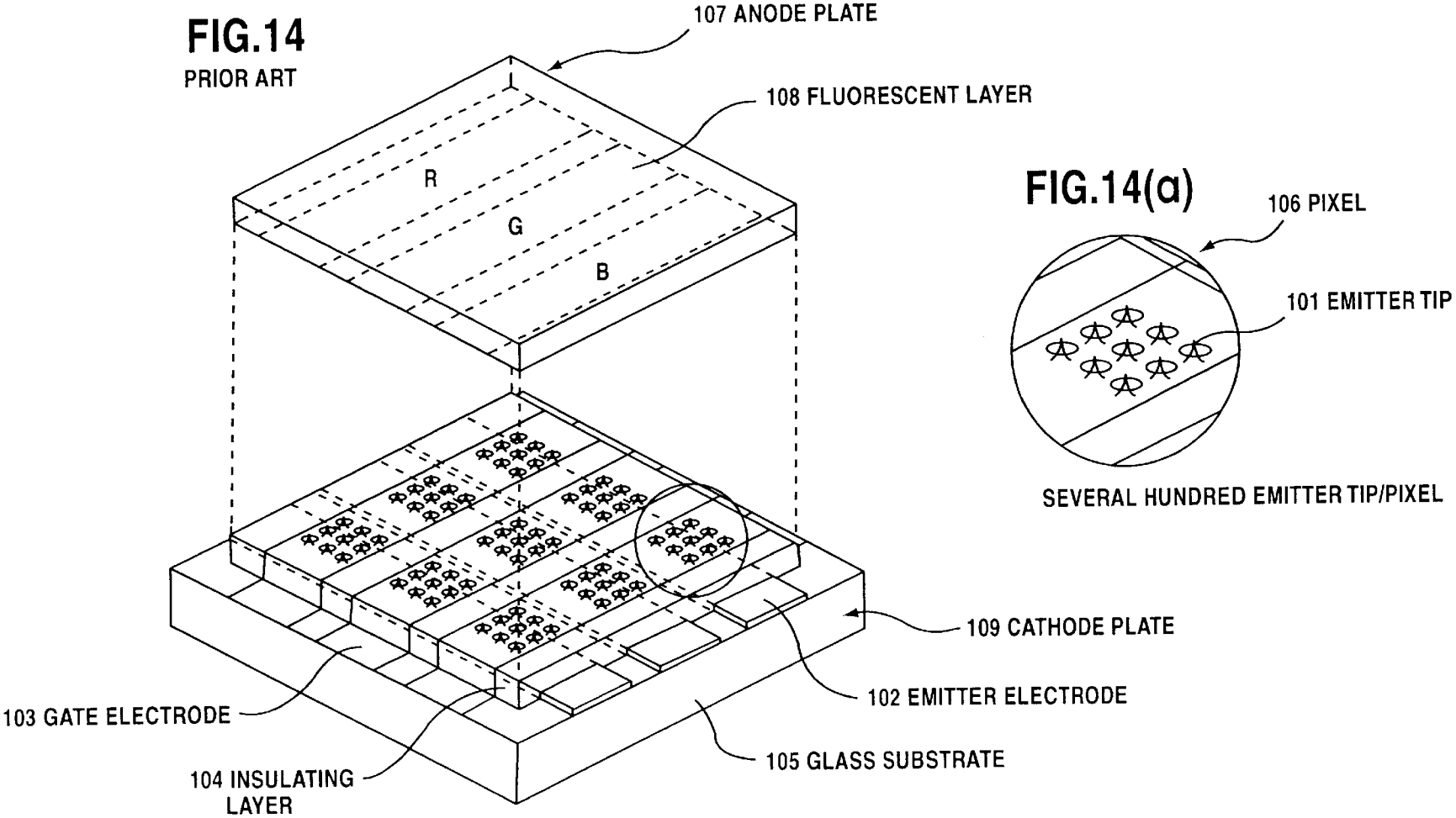
FIG.14 PRIOR ART
FIG. 14 is a diagram illustrating the construction of a conventional display device.
Figure 15A:
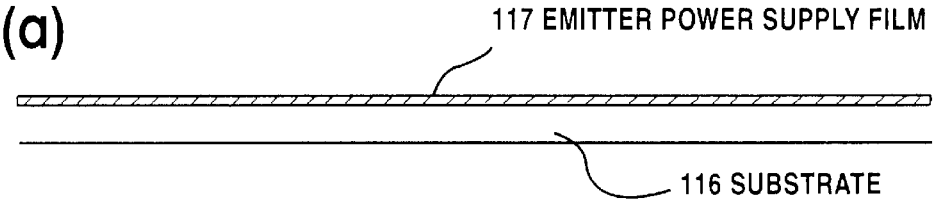
FIG.15(a) PRIOR ART
FIGS. 15(*a*) to 15(*h*) are diagrams for explaining a process for producing a cathode plate of the conventional display device.
Figure 15B:
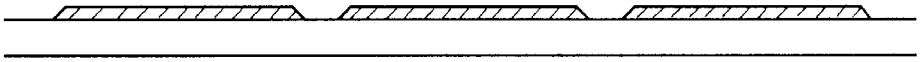
FIG.15(b) PRIOR ART
Figure 15C:
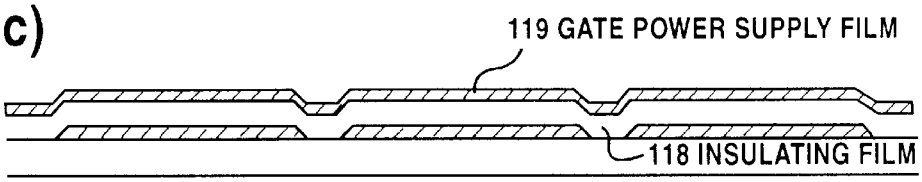
FIG.15(c) PRIOR ART
Figure 15D:
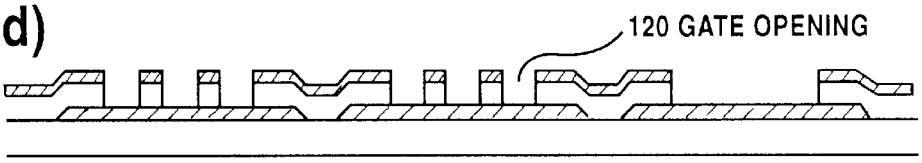
FIG.15(d) PRIOR ART
Figure 15E:
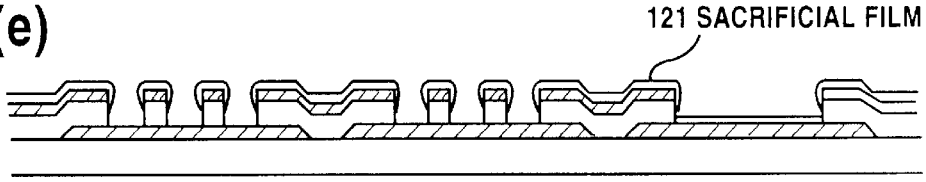
FIG.15(e) PRIOR ART
Figure 15F:
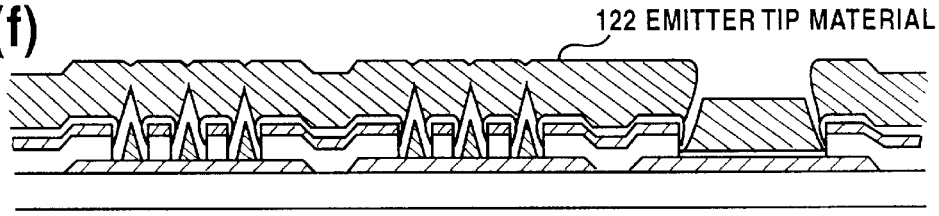
FIG.15(f) PRIOR ART
Figure 15G:
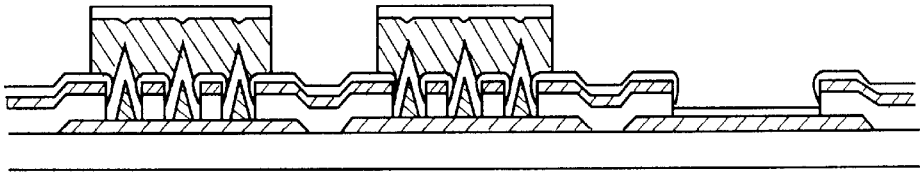
FIG.15(g) PRIOR ART
Figure 15H:
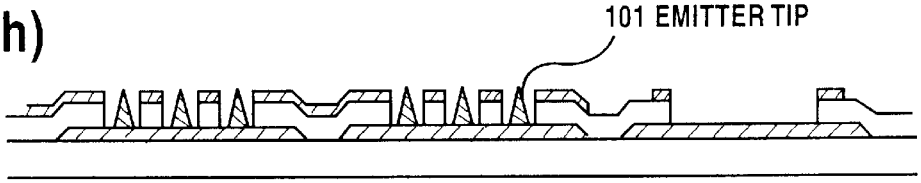
FIG.15(h) PRIOR ART
Figure 16A:
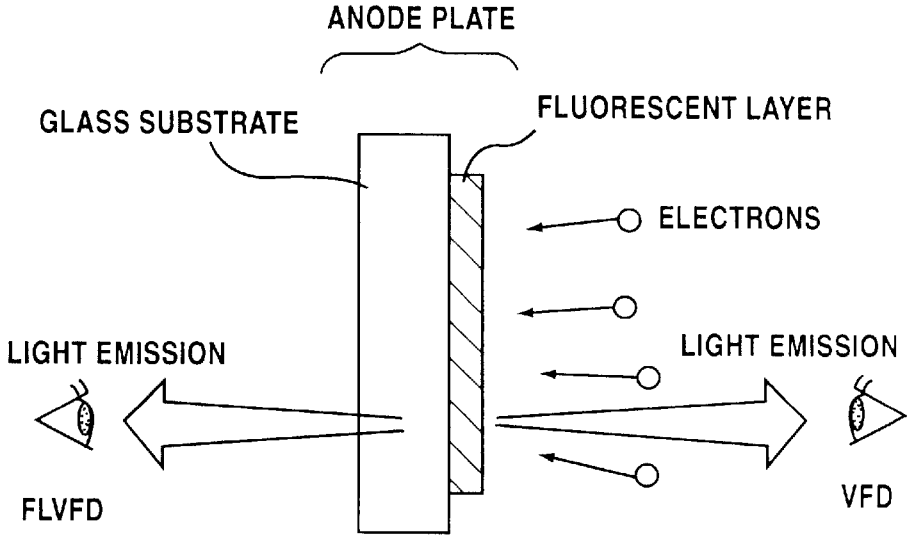
FIG.16(a) PRIOR ART
FIG. 16(*a*) is a schematic diagram illustrating a conventional anode plate.
Figure 16B:
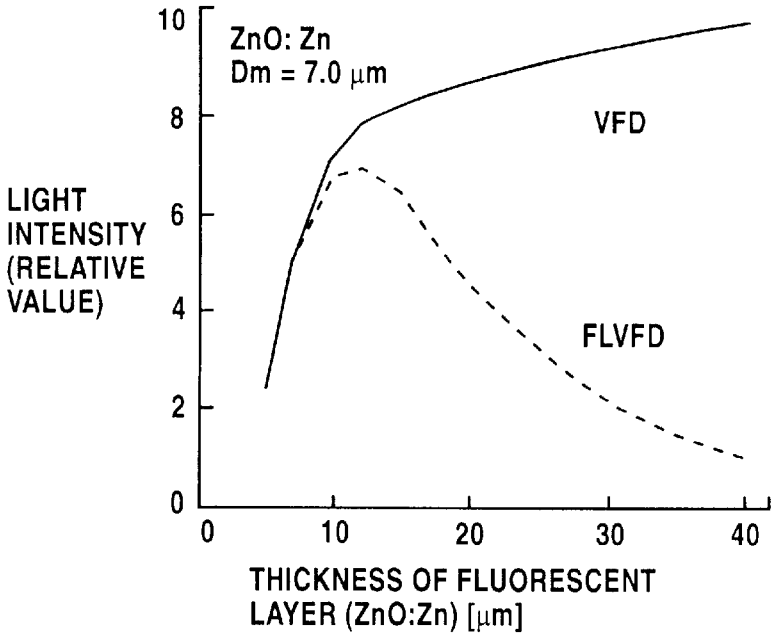
FIG.16(b) PRIOR ART

FIG. 11 is a diagram illustrating the construction of a flat display having ventilation tubes provided on a getter support plate 22. As shown, several ventilation tubes 28 each containing a getter 26' are provided on the rear face of the getter support plate 22. A cathode plate 10 and an anode plate 11 having the same construction as those employed in the fourth embodiment are used.

In this embodiment, the flat display is evacuated through the ventilation tubes 28 after the cathode plate 10, the anode plate 11 and the getter support plate 22 are bonded to each other with a sealer 27. When the vacuum level inside the flat display reaches a predetermined level (e.g., $1\times10^{-8}$ Torr), the ventilation tubes are sealed and the getter 26' is heated for activation thereof.

With this arrangement, the thickness of the flat display is increased by the projection of the ventilation tubes 28. However, the sealing of the flat display does not have to be carried out in a vacuum vessel, so that the flat display can be produced by utilizing the conventional production techniques for CRTs and PDPs.

In accordance with the present invention, light emission from the fluorescent layers is viewed through the cathode plate and, therefore, the flat display employing the minute field emission cathode exhibits a higher luminance than the conventional one.

Further, since the getter is provided on the rear side of the anode plate and the through-holes are provided adjacent to the fluorescent layers for ventilation, the destruction of the emitter tips can be prevented, thereby allowing the flat display to have an extended lifetime and an increased display area.

What is claimed is:

1. A flat display comprising:

a cathode plate including emitter electrode lines each having emitter tips provided in pixel areas, and gate electrode lines crossing the emitter electrode lines at the pixel areas; and an anode plate spaced a predetermined distance from the cathode plate in an opposed relation and having an anode conductive layer and fluorescent layers formed on the anode conductive layer in the respective pixel areas;

wherein the emitter electrode lines and the gate electrode lines are each formed of a double layer structure of a metal film and a transparent conductive film and the pixel areas of the emitter electrode lines and the gate electrode lines are formed of transparent conductive films so that light emission from the fluorescent layers can be viewed through the cathode plate.

2. A flat display of claim 1, further comprising:

a floating gate electrode portion provided in an area embracing a group of emitter tips within each of the pixels and isolated from a gate electrode line;

the floating gate electrode portion being formed of a transparent conductive film, and connected to the gate electrode line via a narrow metal film bridge.

3. A flat display of claim 1 or 2, further comprising:

a rear plate disposed on a side of the anode plate opposite to the cathode plate; and a getter provided in a ventilation space defined between the anode plate and the rear plate;

wherein the anode plate has a plurality of ventholes formed therein.

4. A flat display of claim 3, wherein the ventholes are provided adjacent to the fluorescent layers on the anode plate.

5. A flat display of claim 3, wherein the getter is a getter plate which is supported on the rear plate to face opposite to the respective ventholes.

6. A flat display of claim 4, wherein the getter is a getter plate which is supported on the rear plate to face opposite to the respective ventholes.

7. A flat display of claim 3, further comprising a plurality of spacers between the anode plate and the rear plate so as to support the ventilation space, wherein the getter includes a plurality of getter plates which are supported on the rear plate to face opposite to the respective ventholes.

8. A flat display of claim 4, further comprising a plurality of spacers between the anode plate and the rear plate so as to support the ventilation space, wherein the getter includes a plurality of getter plates which are supported on the rear plate to face opposite to the respective ventholes.

9. A flat display comprising:

a cathode plate including emitter electrode lines each having emitter tips provided in pixel areas, and gate electrode lines crossing the emitter electrode lines at the pixel areas;

an anode plate spaced a predetermined distance from the cathode plate in an opposed relation and having an anode conductive layer and fluorescent layers formed on the anode conductive layer in the respective pixel areas; and a floating gate electrode portion provided in an area embracing a group of emitter tips within each of the pixels and isolated from a gate electrode line;

wherein the floating gate electrode portion being formed of a transparent conductive film, and connected to the gate electrode line via a narrow metal film bridge, and the emitter electrode lines and the gate electrode lines each having transparent portions formed of a transparent conductive film at least in the pixel areas so that light emission from the fluorescent layers can be viewed through the cathode plate.

10. A flat display comprising:

a cathode plate including emitter electrode lines each having emitter tips provided in pixel areas, and gate electrode lines crossing the emitter electrode lines at the pixel areas;

an anode plate spaced a predetermined distance from the cathode plate in an opposed relation and having an anode conductive layer and fluorescent layers formed on the anode conductive layer in the respective pixel areas;

a rear plate disposed on a side of the anode plate opposite to the cathode plate; and a getter provided in a ventilation space defined between the anode plate and the rear plate;

wherein the anode plate has a plurality of ventholes formed therein, and the emitter electrode lines and the gate electrode lines each having transparent portions formed of a transparent conductive film at least in the pixel areas so that light emission from the fluorescent layers can be viewed through the cathode plate.

11. A flat display of claim 10, wherein the ventholes are provided adjacent to the fluorescent layers on the anode plate.

12. A flat display of claim 10, wherein the getter is a getter plate which is supported on the rear plate to face opposite to the respective ventholes.

13. A flat display of claim 11, wherein the getter is a getter plate which is supported on the rear plate to face opposite to the respective ventholes.

14. A flat display of claim 10, further comprising a plurality of spacers between the anode plate and the rear plate so as to support the ventilation space, wherein the getter includes a plurality of getter plates which are supported on the rear plate to face opposite to the respective ventholes.

15. A flat display of claim 11, further comprising a plurality of spacers between the anode plate and the rear plate so as to support the ventilation space, wherein the getter includes a plurality of getter plates which are supported on the rear plate to face opposite to the respective ventholes.

16. A flat display of claim 10, further comprising:

a floating gate electrode portion provided in an area embracing a group of emitter tips within each of the pixels and isolated from a gate electrode line;

the floating gate electrode portion being formed of a transparent conductive film, and connected to the gate electrode line via a narrow metal film bridge.

17. A flat display of claim 16, wherein the ventholes are provided adjacent to the fluorescent layers on the anode plate.

18. A flat display of claim 16, wherein the getter is a getter plate which is supported on the rear plate to face opposite to the respective ventholes.

19. A flat display of claim 17, wherein the getter is a getter plate which is supported on the rear plate to face opposite to the respective ventholes.

20. A flat display of claim 16, further comprising a plurality of spacers between the anode plate and the rear plate so as to support the ventilation space, wherein the getter includes a plurality of getter plates which are supported on the rear plate to face opposite to the respective ventholes.

21. A flat display of claim 17, further comprising a plurality of spacers between the anode plate and the rear plate so as to support the ventilation space, wherein the getter includes a plurality of getter plates which are supported on the rear plate to face opposite to the respective ventholes.

* * * * *